US006949126B2

(12) United States Patent
Taylor et al.

(10) Patent No.: US 6,949,126 B2
(45) Date of Patent: Sep. 27, 2005

(54) PRODUCTION OF DYED LYOCELL GARMENTS

(75) Inventors: James Martin Taylor, Derby (GB); Geoffrey William Collins, Derby (GB)

(73) Assignee: Lenzing Fibers Limited, Spondon Derby (GB)

( * ) Notice: Subject to any disclaimer, the term of this patent is extended or adjusted under 35 U.S.C. 154(b) by 67 days.

(21) Appl. No.: 10/470,038

(22) PCT Filed: Jan. 23, 2002

(86) PCT No.: PCT/GB02/00287

§ 371 (c)(1),
(2), (4) Date: Jul. 24, 2003

(87) PCT Pub. No.: WO02/059416

PCT Pub. Date: Aug. 1, 2002

(65) Prior Publication Data

US 2004/0117923 A1 Jun. 24, 2004

(30) Foreign Application Priority Data

Jan. 24, 2001 (GB) ..... 0101815

(51) Int. Cl.[7] ..... D06P 7/00; D06P 1/54

(52) U.S. Cl. ..... 8/493; 8/494; 8/495; 8/496; 8/543; 8/116.1; 8/116.4

(58) Field of Search ..... 8/493–496, 543, 8/116.1, 116.4

(56) References Cited

U.S. PATENT DOCUMENTS

| | | | | | |
|---|---|---|---|---|---|
| 4,246,221 | A | | 1/1981 | McCorsley, III | 264/203 |
| 5,310,424 | A | * | 5/1994 | Taylor | 8/190 |
| 5,580,354 | A | | 12/1996 | Taylor | 8/53.8 |
| 5,709,716 | A | | 1/1998 | Taylor | 8/401 |
| 5,759,210 | A | * | 6/1998 | Potter et al. | 8/181 |
| 5,919,412 | A | * | 7/1999 | Firgo et al. | 264/187 |
| 6,136,432 | A | * | 10/2000 | Burrow et al. | 428/362 |
| 6,375,685 | B2 | * | 4/2002 | Payet | 8/116.4 |

FOREIGN PATENT DOCUMENTS

| | | |
|---|---|---|
| EP | 0538977 A1 | 4/1993 |
| EP | 1031653 A1 | 8/2000 |
| GB | 2316690 A | 3/1998 |
| GB | 2322142 A | 8/1998 |
| WO | WO 94/09191 | 4/1994 |
| WO | WO 95/00697 | 1/1995 |

OTHER PUBLICATIONS

Daniel Puthier, "Traitement du tissu Tencel", Industrie Textile, No. 1283, pp. 60–65, Jan. 1997 (English Abstract on p. 64).

WPI Abstract, one page abstract of JP 2000–054268 A, Feb. 2000.

WPI Abstract, one page abstract of JP 8100374 A, Apr. 1996.

* cited by examiner

*Primary Examiner*—Margaret Einsmann
(74) *Attorney, Agent, or Firm*—Howson and Howson

(57) ABSTRACT

Garments are constructed from lyocell fabric which has been resinated using a textile resin having just two groups per molecule which can reactively cross-link with cellulose molecules of the lyocell fabric then causticised by application under tension of an aqueous solution of sodium hydroxide, and the constructed garments are dyed in a garment dyeing operation. Garments can be produced by this route which retain a smooth, evenly-dyed appearance with unpuckered seams and minimal creasing and so present a desired formal look, as distinct from the casual look imparted by the effects of fibrillation normally produced when lyocell garments undergo garment dyeing.

20 Claims, No Drawings

PRODUCTION OF DYED LYOCELL GARMENTS

FIELD OF THE INVENTION

This invention relates to a process for producing dyed garments constructed from lyocell fabric.

In this specification, the term "lyocell fabric" means a fabric woven or of knitted using staple fibre yarns comprising lyocell fibres. Such yarns may be made up of just lyocell fibres or of a blend of lyocell fibres with one or more other cellulosic or non-cellulosic (e.g. synthetic) fibre types such as cotton, viscose, linen, polyester and nylon. Furthermore, the fabric may be made up only of such yarns comprising lyocell fibres or may additionally include yarns which do not incorporate lyocell fibres, for example yarns of the other fibre types referred to and blends thereof.

Lyocell fibres are produced by extrusion of a solution of cellulose through a spinning jet into a coagulation bath by a process known as solvent spinning. Such a process is described in U.S. Pat. No. 4,246,221 and uses as the solvent an aqueous tertiary amine N-oxide, particularly N-methylmorpholine N-oxide. Lyocell fibres are distinguished from other man-made cellulose fibres, which are produced by forming the cellulose into a soluble chemical derivative and then extruding a solution of this derivative into a bath which regenerates the extrudate as cellulose fibres; viscose fibres including the high strength modal types are produced in that way.

Lyocell fabrics are used to construct garments by conventional methods, including the cut and sew method in which shaped panels are cut from a length of fabric and then sewn together along seams to constitute a garment. In respect of producing dyed garments from lyocell fabric, the characteristics of lyocell fibres make it necessary to use particular measures in relation to the dyeing process.

BACKGROUND OF THE INVENTION

Lyocell fibres have a tendency to fibrillate during vigorous wet processing such as dyeing. A virtue can be made of this tendency by using procedures which remove the matted, hairy effect produced on the surface of the fabric during dyeing (so-called primary fibrillation) whilst allowing the development of the relatively short surface fibrils (so-called secondary fibrillation) which impart a soft touch to the fabric. This soft touch has been successfully used in casual clothing such as casual shirts, blouses, skirts and trousers, where the surface effect is often known as a peach-touch finish.

For such casual clothing, it has been possible both to dye the lyocell fabric in the length and then make up garments from the dyed fabric and also to make up garments from the undyed fabric and then dye the garments.

For clothing which is required to have a more formal look such as smart shirts and blouses for office wear and smart trousers and skirts, for example with pleats, then the soft-touch lyocell fabric is not so appropriate and a clean, smooth fabric is required. This entails using processing methods which avoid inducing fibrillation of the lyocell fibres.

The conventional route for processing garments having a formal look from lyocell fabric involves dyeing the fabric in open width, for example by a pad-dyeing process, so as to minimise vigorous action on the fabric, and then resinating the fabric with a textile finishing resin such as an N-methylol resin, for example a cyclic resin based on dimethylol dihydroxyethyleneurea (DMDHEU). Additional pre-dyeing steps may include singeing of the fabric, scouring to remove weaving size and causticising, in which sodium hydroxide solution is applied to the fabric to improve its performance against wet creasing. The resin treatment imparts some crease resistance to the fabric and serves to protect the lyocell fibres against fibrillating in later processing.

The dyed and resinated fabric is then cut into shaped panels, which are assembled into garments using conventional methods. The garments may then be given a light wash using a rinse aid and softener before being dried.

Whilst this process route has been used successfully to produce formal-look garments of dyed lyocell fabric, it has disadvantages in that it produces fabrics which are rather stiff and harsh in hand and it requires long production runs for each colour if it is to be economic. Moreover, as is well known, resination of the fabric has a deleterious effect on its abrasion resistance. One proposal for alleviating this fall in abrasion resistance is described in GB 2,322,142 and involves reversing the steps of resinating and causticising the fabric prior to dyeing the fabric. In this proposal, causticising and dyeing are to be carried out on the fabric in rope form in a jet-dyeing machine.

With regard to garment dyeing of lyocell fabric, so far this has been confined to producing soft-touch fabric garments for casual wear, and an undyed garment made from lyocell fabric has not been produced which can retain a formal look through the standard garment dyeing processes.

DISCLOSURE OF THE INVENTION

According to the present invention, a process for producing dyed garments constructed from lyocell fabric comprises the steps of:—

(a) applying to a lyocell fabric a textile resin having two groups only per molecule which can reactively cross-link with cellulose molecules of the lyocell fabric, (b) drying the fabric and heating it to effect the resin cross-linking reaction, (c) causticising the resinated lyocell fabric by applying to it under tension an aqueous solution of sodium hydroxide, and (d) dyeing the resinated, causticised, lyocell fabric, characterised by constructing the fabric into garments after step (c), and carrying out step (d) as a garment dyeing operation.

The invention includes a dyed garment produced by the process of the invention. Uniquely for a garment-dyed lyocell fabric garment, this may be a garment having a formal look in which the fabric and seams have a clean, smooth appearance with unpuckered, evenly-dyed seams and minimal creasing.

The ability to produce such garments using the process of the invention is of commercial importance. It means that garments may be held in an undyed state but ready for dyeing in response to whatever colours are demanded by customers. Furthermore, it has been found that dyeing the lyocell fabric by a garment dyeing process, as opposed to dyeing the fabric in the length before construction of the garment, has additional advantages. The resulting dyed garments are softer and more comfortable to wear and the garment seams are more evenly dyed with less propensity for lightening of shade along seam edges.

The garment dyeing process may be any conventional process used for dyeing garments, including those processes carried out in rotary drum dyeing machines. Whereas such dyeing processes would normally cause damage to a garment made from a lyocell fabric, resulting in surface hairiness from fibrillation, abrasion marks and puckered seams, the process of the invention is able to avoid these problems and to deliver dyed garments having a smooth, evenly-dyed appearance without seam pucker and so presenting the desired formal look.

Conventional dyes and dye recipes for cellulosic fabrics may be used in the process of the invention. Dyes which may be used include reactive dyes, direct dyes, vat dyes and sulphur dyes. Dye manufacturers' recommended conditions for dyeing may be followed.

The dyed garments of the invention have a good balance of properties achieved by use of the specified resin selection and process sequence. Abrasion resistance is improved and good dye yields and even dyeing are obtained despite the deleterious effect on these properties which resination normally produces.

Before the process of the invention is carried out, the lyocell fabric may be pre-treated. If weaving, for example, has resulted in excessive hairiness of the fabric surface, then the fabric may be singed to remove this. Weaving size may be removed by scouring the fabric in an aqueous bath containing, for example, a non-ionic detergent and sodium carbonate, after which the fabric may be dried on a stenter or on heated cylindrical cans.

The textile resins used in the resination step are of the type having only two reactive groups per molecule which can reactively cross-link with cellulose molecules of the lyocell fabric. Such resins include conventional formaldehyde-containing resins such as urea-formaldehyde resins and also resins of the zero-formaldehyde type. Examples of zero-formaldehyde resins are disclosed in WO 95/00697 and include dimethylolethyleneurea (DMEU), 1,3-dimethylolpropyleneurea (DMPU), compounds based on urones or triazinone or carbamates, 1,3-diethyl-4,5-dihydroxy(alkoxy)ethyleneurea and its derivatives. Examples of urea-formaldehyde resins are those sold under the trademark KAURIT (KAURIT is a trademark of BASF AG) Resins having more than two reactive groups per molecule such as DMDHEU are not suitable for use in the process of the invention because they allow only poor dye yields and cause skittery, uneven dyeing of the garments.

Whilst zero-formaldehyde resins are preferred for use in the process of the invention, formaldehyde-containing resins such as urea-formaldehyde resins may also be used because the resination step takes place early in the processing sequence before the wet processing steps of causticising, washing and dyeing. Thus, any free formaldehyde in the fabric after resination and cross-linking has the maximum opportunity of being washed out of the fabric, leaving little, if any, residual free formaldehyde in the dyed garment. Formaldehyde-containing resins have the advantage of being much less expensive than zero-formaldehyde resins.

The resin is preferably applied to the lyocell fabric in open width. It can be applied by any conventional application method, for example as described in WO 95/00697. Padding the resin onto the fabric from solution in a pad bath is the most common method. The pad bath may also include an appropriate catalyst for the cross-linking reaction and a wetting agent. Acid catalysts such as magnesium chloride and citric acid are commonly used with cross-linking resins.

The resin-impregnated fabric is then dried and heated to effect the cross-linking reaction, for example in a hot air oven or other gaseous atmosphere. The drying step may be just the initial stage of the heating step. The fabric may be passed through the oven held out to width on a stenter. The air temperature in the oven is chosen to suit the requirements of the resin or resin/catalyst cross-linking system. In general, a range of 120° C. to 220° C. is suitable, more preferably 140° C. to 200° C., with curing times usually in the range 30 seconds to 5 minutes.

The amount of resin fixed on the lyocell fabric is preferably at least 1.0 percent by weight owf (on weight of fabric). Whilst amounts greater than 5.0 percent by weight owf can be applied, it is preferred not to apply more resin than is necessary because this can adversely affect the handle and performance of the fabric. In general, fixed resin levels of 1.5 percent to 3.5 percent, preferably 2.0 percent to 3.0 percent, by weight owf are suitable.

The resinated lyocell fabric is then causticised by applying to it under tension, that is to say in open width, an aqueous solution of sodium hydroxide. A pad bath is a suitable method of application. Processing conditions suitable for causticising lyocell fabrics are described in EP 0,749,505. In general, sodium hydroxide solution concentrations of 9 to 16 percent by weight are appropriate for fabrics which are wholly of lyocell fibres or are a blend of lyocell fibres and synthetic fibres such as polyester fibres. However, if the lyocell fabric comprises a blend of lyocell and cotton fibres, for example 40 to 80 percent lyocell and 60 to 20 percent cotton, then the concentration of sodium hydroxide may be increased to the levels conventionally used in mercerizing processes, for example 20 to 34 percent by weight, in order to act on the cotton fibres in the blend as well as the lyocell fibres. The same is true in respect of blends of lyocell fibres and linen fibres.

It is also possible to use these higher concentrations of sodium hydroxide, 20 to 34 percent, for causticising fabrics which are wholly of lyocell fibres or are a blend of lyocell fibres and synthetic fibres, if it is convenient for a producer to treat such fabrics on the same equipment, with the same causticising liquor, as used for treating fabrics comprising lyocell fibres in blend with cotton or linen fibres.

Causticising of cellulosic fabrics is conventionally carried out to improve performance against wet creasing, and this effect is reproduced in the process of the invention. When carried out prior to resination, which is the conventional order of procedure, causticising does not prevent the usual negative effect of resination, namely a fall in the abrasion resistance of the fabric compared to an unresinated fabric. However, carried out after resination, as is done in the process of the invention, it can give rise to raised values of abrasion resistance, including values which are greater than for the unresinated fabric. For example, a lyocell fabric which withstands 15,000 rubs in a Martindale abrasion test when unresinated may only withstand 10,000 rubs after being causticised and then resinated, whereas after being resinated and then causticised it may withstand 20,000 rubs or more.

Causticising the lyocell fabric also has the effect of bringing dye yields back to commercially-acceptable levels from the depressed dye yields caused by resination, as well as promoting evenness of dyeing. For the purpose of the latter requirement, causticising is carried out on the fabric whilst it is in open width; causticising the fabric in rope form gives rise to poor dyeing later.

The good dye yields achievable are demonstrated in the Martindale abrasion test where, at the end of the test, the fabric of garments according to the invention showed no shade change at the edge of abraded fabric encircling the failure area. A whitened fabric edge in this test indicates inadequate dye penetration, and this is an effect which would highlight abrasion of garment seams and edges and is therefore to be avoided.

After causticising, the lyocell fabric is washed to remove residual sodium hydroxide, for example successive washes in hot and then cold water. If necessary, one of the washes may include a weak acid for purposes of neutralization.

The washed fabric is then dried, a usual method involving passing the wet fabric around a train of steam-heated rollers or cylindrical cans.

The fabric may be constructed into garments by conventional methods, the most common one being to cut shaped panels from the fabric and then to assemble them together along sewn seams. The garments are still in the ecru, undyed state and are ready for a garment dyeing operation as already described.

After dyeing, the garments may be washed to remove unfixed dye, given a treatment with a soft finish and then dried, for example tumble-dried.

The invention is illustrated by the following Examples. In all of the Examples, the lyocell fibres used were produced by Tencel Limited under the trademark TENCEL.

EXAMPLE 1

A lyocell fabric comprised a woven fabric of basis weight 185 gsm (grams per square meter) constructed in a 3 by 1 twill weave from yarns of count 1/24 s Ne composed of 100 percent lyocell fibres. The fabric was scoured in open width to remove the water-soluble polyvinyl alcohol weaving size using an aqueous scour bath containing a non-ionic detergent and sodium carbonate and at a temperature of 90° C. It was then dried on cylindrical cans at a temperature of 100° C.

Resination of the fabric was carried out with the fabric in open width by a padding process operating at an expression of 75 percent wet pick up using a pad bath containing:—

1.0 g/l (gram per liter) Kieralon JET B (wetting agent)
20.0 g/l Condensol M (acid catalyst)
80.0 g/l PT22 (urea-formaldehyde resin).
(Kieralon and Condensol are trademarks of BASF AG and U/F resin PT22 is supplied by Brookstone Chemicals).

The impregnated fabric was dried on a stenter in air at a temperature of 110° C. and then was heated in air in a curing oven at a temperature of 160° C. for 4.0 minutes to effect the cross-linking reaction between the resin and the cellulose of the lyocell fabric.

Causticising of the resinated fabric was carried out with the fabric in open width on a chainless merceriser using a 10 percent by weight aqueous solution of sodium hydroxide at ambient temperature for a dwell time of 45 seconds. The impregnated fabric was then washed successively in hot and cold water before being dried on cylindrical cans at a temperature of 100° C.

The dried fabric was cut into shaped panels, which were assembled and sewn together along seams to make men's shirts of formal type.

The shirts were dyed in a garment dyeing machine of the rotary drum type, comprising a Tupesa Ecodye 25 open pocket machine, using the hot exhaust migration dyeing method with the dye manufacturer's recommended conditions and a fixation temperature of 80° C. The dye bath comprised:—

Procion Navy H-EXL at 6.0 percent owf (on weight of fabric),
Sodium sulphate at 80.0 g/l,
Sodium carbonate at 20.0 g/l.

After dyeing, the shirts were rinsed with water in the dyeing machine and then gently tumbled in an aqueous solution of a soft finish (2.0 percent owf of Edunine CSA) at a temperature of 40° C. (Edunine CSA is a trademark of Uniqema). The shirts were then tumble-dried.

The shirts were evenly dyed to a full dark shade and had a clean, smooth appearance with unpuckered, evenly-dyed seams and minimal creasing, giving the shirts the desired formal look.

Samples of fabric were cut from the shirts and tested for abrasion resistance and free formaldehyde content. The abrasion test was the Martindale test and gave a result of 25,000 rubs. The free formaldehyde content was below 20 ppm (parts per million).

EXAMPLE 2

A lyocell fabric comprised a woven fabric of basis weight 209 gsm constructed in a 2 by 1 twill weave from yarns of count 1/20 s Ne. The yarns were an intimate blend of lyocell and cotton fibres in proportion 60 lyocell:40 cotton by weight.

The fabric was scoured in open width as described in Example 1 but using sodium hydroxide instead of sodium carbonate. The scoured fabric was bleached in an aqueous solution of hydrogen peroxide, sodium hydroxide and peroxide stabilizer, steamed at a temperature of 100° C. for 8 minutes and then washed with water before being dried on cylindrical cans at a temperature of 100° C.

The prepared fabric was then resinated and causticised as described in Example 1, except that the sodium hydroxide concentration was at the full mercerizing level of 30 percent so as to affect the 40 percent cotton content of the fabric as well as the lyocell content.

The causticised fabric was then washed and dried as described in Example 1 before being cut into shaped panels, which were sewn together to make men's shirts of formal type. The shirts were dyed and finished as described in Example 1.

The blended lyocell/cotton of the shirts' fabric displayed a good dye union, being evenly dyed to a full dark shade, and the shirts had the desired formal look as described in relation to the shirts of Example 1.

Free formaldehyde content was again below 20 ppm and the Martindale abrasion resistance of the shirt fabric was 26,000 rubs.

EXAMPLE 3

A lyocell fabric comprised a woven fabric of basis weight 225 gsm constructed in a plain weave from yarns of count 1/10 s Ne. The yarns were an intimate blend of lyocell and linen fibres in 50:50 proportion by weight.

The fabric was processed and was then converted into shirts, which were dyed and finished all as described in Example 2.

The blended lyocell/linen of the shirts' fabric displayed a good dye union, being evenly dyed to a full dark shade, and the shirts had the desired formal look as described in relation to the shirts of Example 1.

Free formaldehyde content was again below 20 ppm and the Martindale abrasion resistance of the shirt fabric was 38,000 rubs.

EXAMPLE 4

A lyocell fabric comprised a woven fabric of basis weight 225 gsm constructed in a 2 by 1 twill weave from yarns of count 1/16 s Ne. The yarns were an intimate blend of lyocell and polyester fibres in 50:50 proportion by weight.

The fabric was processed as described in Example 1 with the addition, after scouring and drying, of a heat-treatment of the stentered fabric at a temperature of 195° C. for 45 seconds in order to set the polyester component. The treated fabric was made into shirts, which were dyed and finished as described in Example 1.

The shirt fabric had an attractive dyed mélange effect resulting from the full dark shade acquired by the lyocell component and the undyed polyester component. The shirts had a clean, smooth appearance and presented the desired formal look.

Free formaldehyde content of the shirt fabric was below 20 ppm. The Martindale abrasion test gave a result of 66,000 rubs.

EXAMPLE 5

A lyocell fabric comprised a woven fabric of basis weight 200 gsm constructed in a 2 by 1 twill weave from yarns of count 1/20 s Ne. The yarns were an intimate blend of lyocell and cotton fibres in proportion 60 lyocell:40 cotton by weight.

The fabric was desized by scouring as described in Example 1 and was then dried on a stenter. The prepared fabric was then resinated by padding it in open width at an expression of 80 percent wet pick up with an aqueous solution containing:—

1.0 g/l Kieralon JET B (wetting agent)
50.0 g/l Kaurit S (urea-formaldehyde resin)
15.0 g/l Magnesium chloride hexahydrate (acid catalyst)
(Kaurit S is a trademark of BASF AG)

The impregnated fabric was dried in air on a stenter at a temperature of 110° C. and then heated in air in a curing oven at a temperature of 160° C. for 2.0 minutes to effect cross-linking of the resin. Uptake of fixed resin was 3.5 percent owf.

The resinated fabric was causticised by passing the fabric in open width on a chainless merceriser through an aqueous solution of sodium hydroxide at ambient temperature and at mercerizing strength (310 g/l) for a dwell time of 1.0 minute. The impregnated fabric was then washed with water and neutralized with an aqueous solution of 1.0 ml/l of acetic acid before being dried on a stenter at a temperature of 100° C.

The dried fabric was cut into shaped panels, which were sewn together to make shirts of formal type.

The shirts were dyed in a Tupesa Ecodye 25 open pocket garment dyeing machine using the hot exhaust migration dyeing method with the dye manufacturer's recommended conditions. The dyebath comprised:—

Drimarene Navy X-GN at 6.2 percent owf
Drimarene Red X-6BN at 1.6 percent owf
Drimarene Yellow X-4RN at 2.5 percent owf
Sodium sulphate at 80 g/l
Sodium carbonate at 20 g/l.

After dyeing, the shirts were rinsed with water in the dyeing machine and then gently tumbled in an aqueous solution of a soft finish (2.0 percent owf of Edunine CSA) at a temperature of 40° C. before being tumble-dried. The shirts were evenly dyed to a full black colour with good colour union between the lyocell and cotton components, and they had a clean, smooth appearance with unpuckered, evenly-dyed seams and virtually no creases. They presented the desired formal look.

EXAMPLE 6

The lyocell fabric used in Example 5 was processed and converted into shirts, which were dyed and finished all as described in Example 5 with the exception that the resin used for the resination step was not Kaurit S but was a zero-formaldehyde resin, Fixapret NF, used in a concentration of 100 g/l. (Fixapret NF is a trademark of BASF AG.) The level of resin fixed on the fabric after cross-linking was 2.5 percent owf.

The finished shirts were again evenly dyed to a full black colour with good colour union between the lyocell and cotton components. They were similar in appearance to the shirts of Example 5 and had the desired formal look.

What is claimed is:

1. A process for producing dyed garments constructed from lyocell fabric comprising the steps of (a) applying to a lyocell fabric a textile resin having two groups only per molecule which can reactively cross-link with cellulose molecules of the lyocell fabric;

(b) drying the fabric and heating it to effect the resin cross-linking reaction;

(c) causticising the resinated lyocell fabric by applying to it under tension an aqueous solution of sodium hydroxide, and (d) dyeing the resinated, causticised, lyocell fabric, in which process the fabric is constructed into garments after step (c), and step (d) is carried out as a garment dyeing operation.

2. A process according to claim 1, wherein the garments are dyed with a reactive dye.

3. A process according to claim 1, wherein the lyocell fabric has the textile resin applied to it in open width.

4. A process according to claim 3, wherein in the textile resin is a formaldehyde-containing resin.

5. A process according to claim 1, wherein the textile resin is a zero-formaldehyde resin.

6. A process according to claim 4, wherein the textile resin is a urea-formaldehyde resin.

7. A process according to claim 1, wherein the lyocell fabric comprises one of lyocell fibres only and lyocell fibres in blend with synthetic fibres, and wherein the causticising of the fabric is carried out with an aqueous solution comprising 9 to 16 percent by weight of sodium hydroxide.

8. A process according to claim 1, wherein the lyocell fabric comprises lyocell fibres in blend with one of cotton and linen fibres, and wherein the causticising of the fabric is carried out with an aqueous solution comprising 20 to 34 percent by weight of sodium hydroxide.

9. A process according to claim 1, wherein the dyed garments are treated with a soft finish before being dried.

10. A process according to claim 2, wherein the lyocell fabric has the textile resin applied to it in open width.

11. A process according to claim 10, wherein the textile resin is a zero-formaldehyde resin.

12. A process according to claim 11, wherein the lyocell fabric comprises one of lyocell fibres only and lyocell fibres in blend with synthetic fibres, and wherein the causticising of the fabric is carried out with an aqueous solution comprising 9 to 16 percent by weight of sodium hydroxide.

13. A process according to claim 12, wherein the dyed garments are treated with a soft finish before being dried.

14. A process according to claim 11, wherein the lyocell fabric comprises lyocell fibres in blend with one of cotton and linen fibres, and wherein the causticising of the fabric is carried out with an aqueous solution comprising 20 to 34 percent by weight of sodium hydroxide.

15. A process according to claim 10, wherein the textile resin is a formaldehyde-containing resin.

16. A process according to claim 15, wherein the textile resin is a urea-formaldehyde resin.

17. A process according to claim 16, wherein the lyocell fabric comprises one of lyocell fibres only and lyocell fibres in blend with synthetic fibres, and wherein the causticising of the fabric is carried out with an aqueous solution comprising 9 to 16 percent by weight of sodium hydroxide.

18. A process according to claim 16, wherein the lyocell fabric comprises lyocell fibres in blend with one of cotton and linen fibres, and wherein the causticising of the fabric is carried out with an aqueous solution comprising 20 to 34 percent by weight of sodium hydroxide.

19. A dyed garment constructed of lyocell fabric produced by a process comprising the steps of:

(a) applying to a lyocell fabric a textile resin having two groups only per molecule which can reactively cross-link with cellulose molecules of the lyocell fabric;

(b) drying the fabric and heating it to effect the resin cross-linking reaction;

(c) causticising the resinated lyocell fabric by applying to it under tension an aqueous solution of sodium hydroxide, and (d) dyeing the resinated, causticised, lyocell fabric, in which process the fabric is constructed into garments after step (c), step (d) is carried out as a garment dyeing operation, and said dyed garment resulting from step (d) has a formal look.

20. A process for producing dyed garments constructed from lyocell fabric comprising the steps of (a) applying to a lyocell fabric a textile resin having two groups only per molecule which can reactively cross-link with cellulose molecules of the lyocell fabric;

(b) drying the fabric and heating it to effect the resin cross-linking reaction;

(c) causticising the resinated lyocell fabric by applying to it under tension an aqueous solution of sodium hydroxide, and (d) dyeing the resinated, causticised, lyocell fabric, in which process the fabric is constructed into garments after step (c), and step (d) is carried out as a garment dyeing operation that produces a garment with fabric having a smooth appearance and with evenly-dyed, unpuckered seams.

* * * * *